US006073624A

United States Patent [19]

Laurent

[11] Patent Number: 6,073,624

[45] Date of Patent: Jun. 13, 2000

[54] SUPPORTING ARRANGEMENT, FOR OVENS OR THE LIKE, SUSPENDED ON PARALLEL LINKS

[75] Inventor: Ulf Laurent, Motala, Sweden

[73] Assignee: Aktiebolaget Electrolux, Stockholm, Sweden

[21] Appl. No.: 09/230,265

[22] PCT Filed: Jul. 16, 1997

[86] PCT No.: PCT/SE97/01290

§ 371 Date: Mar. 18, 1999

§ 102(e) Date: Mar. 18, 1999

[87] PCT Pub. No.: WO98/04871

PCT Pub. Date: Feb. 5, 1998

[30] Foreign Application Priority Data

Jul. 25, 1996 [SE] Sweden ..... 9602867

[51] Int. Cl.[7] ..... F24C 15/16; F27D 11/00; A47B 81/00

[52] U.S. Cl. ..... 126/334; 126/337 R; 126/273 A; 126/37 B; 126/340; 219/403; 312/272; 312/300; 312/247

[58] Field of Search ..... 126/334, 332, 126/339, 340, 337 R, 273 A, 190, 192, 37 B, 19 M; 266/253; 312/272, 300, 247, 319.2; 219/403, 404, 753, 762, 763; 74/116

[56] References Cited

U.S. PATENT DOCUMENTS

| | | | |
|---|---|---|---|
| 1,921,690 | 8/1933 | Miller | 312/272 |
| 2,382,354 | 8/1945 | Wales | 312/247 |
| 2,944,540 | 7/1960 | Littell, Jr. | 126/273 A |
| 2,987,363 | 6/1961 | Mores | 126/337 R |
| 3,330,612 | 7/1967 | Masterson et al. | 312/300 |
| 3,390,930 | 7/1968 | Peterson | 312/272 |
| 4,074,963 | 2/1978 | Walsh | 266/253 |
| 4,584,890 | 4/1986 | Chevrollier | 74/116 |
| 5,029,935 | 7/1991 | Dufrancatel | 126/37 B |

*Primary Examiner*—Ira S. Lazarus
*Assistant Examiner*—Josiah C. Cocks
*Attorney, Agent, or Firm*—Pearne, Gordon, McCoy & Granger LLP

[57] ABSTRACT

A swing-out supporting arrangement (7) primarily intended for a wall-mounted oven (1) of domestic type comprises a bottom plate (6) supported by link arms (9, 10), said bottom plate (6) and an insert (8), possibly associated with said bottom plate, being retractable from the oven (1) by a swing-out movement without the use of any front door. The bottom plate (6) with the insert (8) can be moved between a first position inside the oven and a second swing-out position below and in front of the over front wall (2). Preferably, the swing-out movement is performed by means of an electric motor which is rotatable between two end positions. The principle of invention can also be used for a ceiling plate (4) supported by link arms, said plate being swingingly displaced in a corresponding lifting movement from an oven positioned at a low level.

11 Claims, 5 Drawing Sheets

SUPPORTING ARRANGEMENT, FOR OVENS OR THE LIKE, SUSPENDED ON PARALLEL LINKS

BACKGROUND OF THE INVENTION

The present invention relates to a supporting arrangement for charging a closed chamber with goods, said supporting arrangement being movable into a swung-out position.

Supporting arrangements of the kind referred to are known to be used in connection with kitchen equipment, such as kitchen cabinets, dishwashing machines and ovens. In this connection said kitchen equipment is of the kind that could be defined as front loaded equipment. Accordingly, there is provided an openable front door through which the supporting arrangement disposed in the chamber of the kitchen equipment can be swung-out by means of linkages each of which being journalled in a respective one of two opposite side walls.

DE-A1-39 30 609 describes a lowerable shelf arrangement for kitchen machines and the like, said shelf arrangement comprising a wall-mounted load carrying shelf plane which can be lowered, by means of a parallelogram type linkage, from a storage level and into a level corresponding to normal working height. The linkage, which is actuated manually, comprises a control cam which cooperates with a control roller supported by a control arm. The known arrangement is under influence of a compression spring and includes a damping member. No information is given as to the use of the load carrying shelf plane in a kitchen cabinet or the like but if put in a cabinet-like space said space has to be provided with a front door in order for the lowering movement of the shelf plane to become possible. The resulting arrangement would be an arrangement similar to that disclosed in DE-A1-29 19 610.

Further examples on household ovens comprising a retractable supporting arrangement are given e.g. in U.S. Pat. No. 1,994,227, U.S. Pat. No. 2,069,706, U.S. Pat. No. 5,447,146, DE-A1-26 11 461 and EP-A3-0 147 815. All these ovens have in common that they are front loaded, i.e. charging takes place via a door at the front surface of the oven. In spite of the fact that maneuvering takes place by means of a linkage, normally, the supporting arrangement performs only a linear displacement movement from/to the oven cavity.

However, U.S. Pat. No. 5,447,146, referred to above, relates to a floor-mounted cooker including an oven the supporting arrangement of which is operated by means of a link arms so that it can be inserted and retracted through a front door, wherein, by means of said link arms it becomes possible to raise the supporting arrangement, and an insert associated therewith, to a suitable working level outside of the oven. This can be achieved by the supporting arrangement being carried by a pair of link arms, bent at a right angle and turnably journalled adjacent to the ceiling of the oven chamber as well as at the side edges of the supporting arrangement. The known supporting arrangement is manually operated by means of a handle at the same time acting on a locking mechanism for adjusting same into different height levels outside of the oven.

As in the other known supporting arrangements discussed above and used for charging of closed chambers, such as cabinets and ovens, the arrangement according to U.S. Pat. No. 5,447,146 requires a front door for the insertion and retraction of the supporting arrangement into and out from the chamber, respectively, which involves a disadvantage, e.g for space reasons. Doors for cabinets and ovens which have to be opened for the charging of the interior chamber often becomes a great hindrance to the person handling the retraction and/or the insertion of goods out from and into the chamber, respectively. Due to the fact that the door is swung in an outward direction the area of movement of the person is encroached which means that said person has to reach out beyond the door. In case of an oven this may even involve a risk of injury as the oven door is often hot with temperatures of 200° C. and more not being unusual.

Furthermore, the demand for mutually equally bent link arms and/or requirements with regard to control cams and gear rings, as disclosed in the U.S. document just referred to, are cumbersome from a manufacturing point of view and, at the same time, this embodiment is hard to get functioning in a reliable way, in particular in ovens with associated temperature variations. In addition, the known supporting arrangements are less suitable for motorized drive.

SUMMARY OF THE INVENTION

The object of the present invention is to provide a supporting arrangement which can be swung out and which eliminate the drawbacks of the known arrangements and can be used in connection with chambers without any need for an openable front door.

The object is achieved by a supporting arrangement according to the present invention which can be swung out.

The supporting arrangement is well suited for a domestic oven. Especially in a domestic oven mounted on a wall and having an inspection window in its front wall the supporting arrangement according to the invention will be of great value. The wall-mounted oven can be placed so as to have its inspection window at eye-level and by means of the supporting arrangement cooperating with the bottom of the oven baking-plates or other oven equipment can be swung downwards and outwards to a suitable working level below the oven and in front of its front wall, e.g. at the level of a worktop.

Corresponding results can also be achieved by the swing-out supporting arrangement according to the invention as used in connection with domestic ovens mounted on a wall at a low level or standing on the floor, wherein the supporting arrangement cooperates with the ceiling of the oven. Said ceiling and the supporting arrangement carried thereunder is swung upwards and outwards to a suitable working level above the oven and in front of its front wall.

Accordingly, the supporting arrangement according to the present invention creates good opportunities for easy accessible handling of goods stored in cabinets or to be treated in an oven. Space demanding doors of cabinets or an oven can be avoided. By the vertical/horizontal motion combination obtained for the supporting arrangement good opportunities are created as well for embodiments suitable for disabled persons, especially as the supporting arrangement of the invention is well suited for being driven by an electric motor.

BRIEF DESCRIPTION OF THE PREFERRED EMBODIMENTS

The swing-out supporting arrangement according to the invention will be illustrated more in detail in the following description given with reference to the enclosed drawings, in which.

DETAILED DESCRIPTION OF THE PREFERRED EMBODIMENTS

Figure 1:
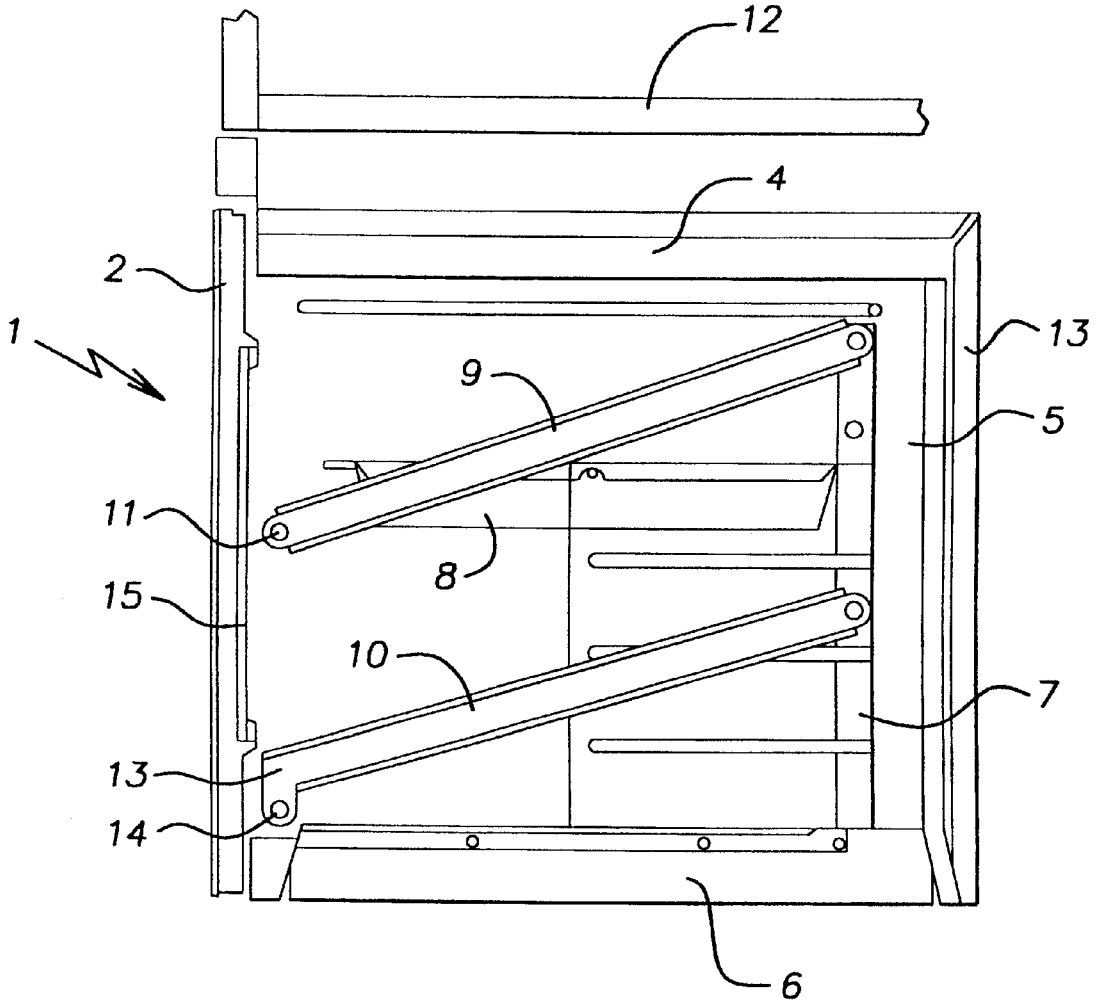
FIG. 1 shows in a side view a wall-mounted domestic oven with the supporting arrangement disposed in its upper position inside an oven chamber.

In FIG. 1 there is shown a preferred embodiment of the invention in the form of a wall-mounted domestic oven 1 seen from the side and with one side wall removed, see the description with reference to FIGS. 2 and 3 below. The oven 1 has an oven chamber defined by fixed front and back walls 2 and 3, respectively, and by fixed top and side walls 4 and 5, respectively (only one side wall has been shown). The bottom or floor 6 of the oven 1 carries a supporting arrangement 7 for baking-plates 8 and other oven equipment. The fixed front wall 2 is provided with a window 15, in a way known per se.

The oven floor 6 and its supporting arrangement 7 is swingingly supported by pairs of link arms 9, 10 swingable in parallel to the side wall plane of the oven 1. Each pair of link arms 9, 10 comprises an upper link arm 9 one end of which being turnably journalled immediately adjacent to the highest point of the supporting arrangement 7, which in its swung-in position in the oven chamber is disposed immediately adjacent to the oven ceiling 4. The other forward end of the link arm 9 is secured to a supporting shaft 11 and turnably journalled on said shaft which extends immediately adjacent to and in level with the horizontal center line of the front wall 2.

The link arm pair 9, 10 also comprises a lower link arm 10 one end of which being turnably journalled on the supporting arrangement 7 approximately at the level of or slightly below the central horizontal line thereof. The opposite forward end of the link arm 10 has a short slanted arm portion 13 the outer end of which being secured to an operating shaft 14 to be turnable therewith. When the supporting arrangement 7 has taken its swung-in position in the oven chamber the slanted arm portion 13 extends in a vertical direction mainly parallel to the front wall 2.

Figure 2:
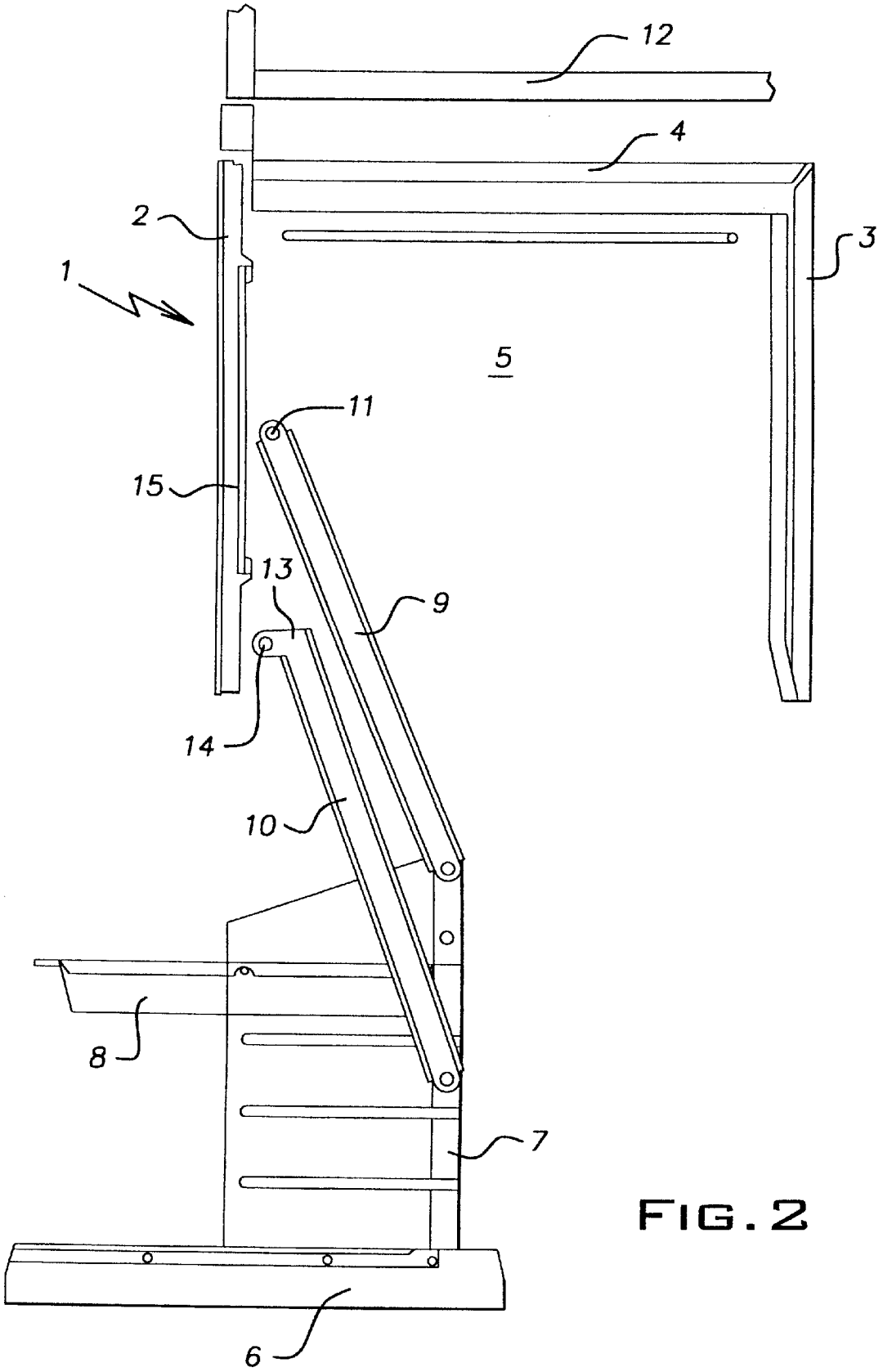
FIG. 2 shows the same view as FIG. 1 but with the supporting arrangement according to the invention in a swung-out position outside the oven, compare the arrow A in FIG. 3.

FIG. 2 shows the supporting arrangement 7 and the floor 6 in their swung-out positions wherein the supporting arrangement is easily accessible for charging without causing any hindrance for the user who neither will face any risk of getting into contact with the open oven door. As appears from FIG. 2, as a result of the placing of the forward journalling ends of the link arm pair 9, 10 said floor 6 with the supporting arrangement 7 will be swung downwards and forwards into a swung-out position in front of the front wall 2 of the oven 1.

Figure 3:
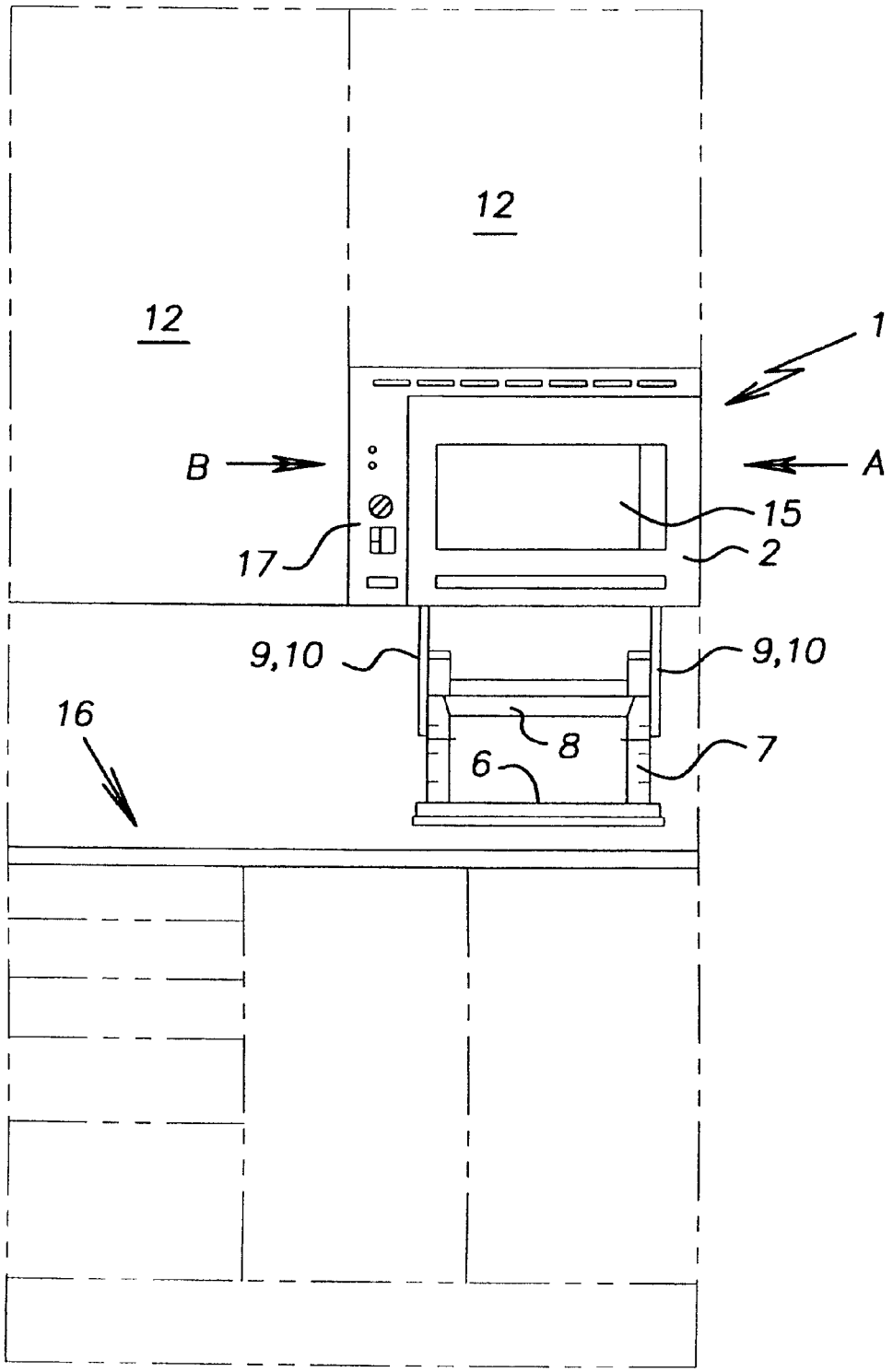
FIG. 3 shows a front view of a wall-mounted domestic oven with the supporting arrangement in its swung-out position like in FIG. 2.

Advantageously, the domestic oven 1 is mounted on a wall together with top cupboards 12 and above a workbench 16, as shown in FIG. 3. Accordingly, this figure shows the oven 1 in a front view, wherein the floor 6 with the supporting arrangement 7 has taken its swung-out position in correspondence with the side view according to FIG. 2 in which the oven 1 can be seen in the direction of the arrow A indicated in FIG. 3.

In a manner known per se the oven 1 is equipped with necessary heating coils, grill elements, oven lighting etc. Controls 17 for the operation of the oven 1 have been positioned at a suitable place either on the oven front 2 or lowered e.g. to the level of the workbench 16. Electric elements, such as heating coils provided in the oven floor 6, are automatically connected by means of connection means, not shown, to current supply leads upon the floor 6 taking the position in which it is completely swung-in.

Figure 4:
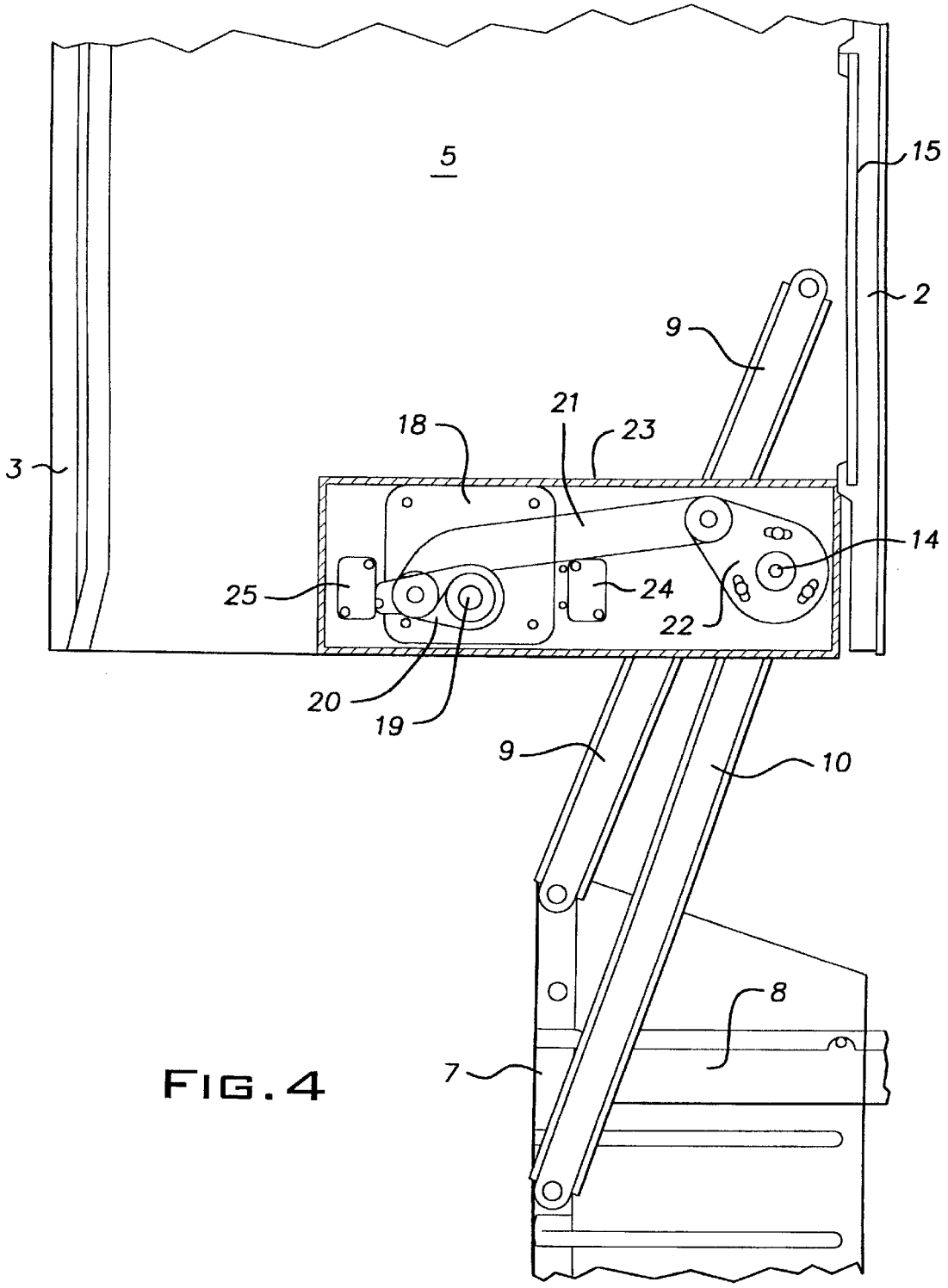
FIG. 4 shows a side view as seen in the direction of the arrow B in FIG. 3 illustrating a preferred embodiment of a motor-driven supporting arrangement according to the invention.

Among the controls 17 there is a control button for operation of an electric motor 18, see FIG. 4, provided for driving of the floor 6 with its supporting arrangement 7 between the swung-out and the swung-in positions, respectively. The motor 18 and the drive mechanism 19-22 are enclosed in a separate cover 23 which, in the present embodiment, is provided outside of the oven chamber, i.e. at the outside of side wall 5. The motor 18 can be operated between two end positions determined by microswitches 24 and 25 and corresponding to the fully swung-in position and the fully swung-out position, respectively, of the supporting arrangement 7 (the latter position shown in FIG. 4).

The drive shaft 19 of the motor 18 is fixed to a first eccentric 20 the outer end of which being adapted to act on the respective microswitch 24, 25 upon the motor having finished its maximum possible turn, compare arrows C. The first eccentric 20 is turnably connected to a transmission arm 21 transmitting the the rotational movement of the motor 18 to a second eccentric 22. This second eccentric 22 is firmly connected to the operating shaft 14 which is in turn firmly connected to the link arm pair 9, 10, as indicated above. By operating the control knob the motor 18 is switched from one end position to the opposite end position and vice versa.

Figure 5:
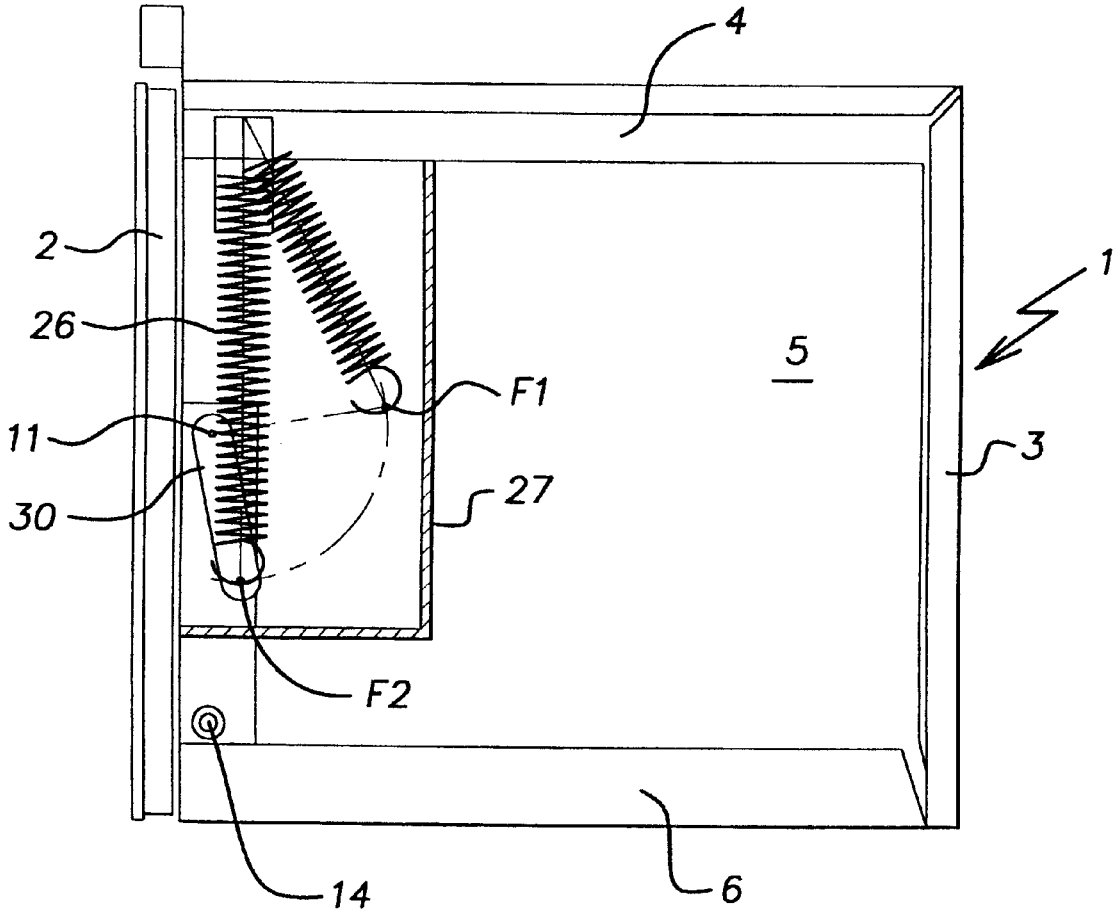
FIG. 5 shows the swing-out supporting arrangement according to the invention provided with energy accumulating spring means for balancing the supporting arrangement during handling.

In order to balance the drive function of the motor 18 during the swing-out movement of the floor 6 with the supporting arrangement 7 from the interior of the oven chamber to the open position below and in front of the oven 1 and the front wall 2 thereof, at least one turning shaft 11, 14 of the link arm pairs 9, 10 is connected to a spring means 30, 26, as shown in FIG. 5. In the embodiment of the supporting arrangement according to the invention, as shown, the supporting shaft 11 for the forward end of the upper link arm 9 of the link arm pairs 9, 10 is fixedly connected to an eccentric 30 the outer end of which being connected to a compression spring 26. The opposite end of the compression spring 26 is journalled in the ceiling 4 of the oven 1.

Accordingly, when the motor 18 drives the floor 6 and the supporting arrangement 7 from its swung-in position in the oven chamber the movement takes place from the spring position F1 and to the spring position F2. Accordingly, the compression spring 26 is tightened and the swing-out movement of the floor 6 with its supporting arrangement 7 takes place against the force of the compression spring 26. Hence, during the swing-in movement of the the floor 6 and its supporting arrangement 7 the motor 18 is assisted by the spring force of the compression spring 26.

Suitably, the spring means 30, 26 is disposed under a separate cover 27 outside of the oven chamber. Advantageously, the spring means 30, 26 and the cover 27 can be disposed at the same side as the motor 18 and its cover 23 even though said parts have been shown as situated at the opposite side of the oven chamber.

The swing-out floor 6 can be designed as a cooker hob with defined heating surfaces for cooking and trying pans. The heating surfaces can be separately controlled in the same way as in an ordinary cooker. Accordingly, in its swung-out position the floor 6 can be used as a cooker hob. If the ceiling 4 of the oven 1 is provided with a suction fan connected to the ventilation system of the housing unit the oven chamber will serve as a hood when cooking takes place on the cooker hob. In the swung-in position in the oven chamber heat from all heating surfaces is utilized.

CONCLUSION

By the swing-out supporting arrangement according to the present invention the following demands on a domestic oven are advantageously met:

Childproof thanks o.a. to the wall mounting feature;

Friendly to disabled persons thanks to the balancing of weight and the use of motor drive;

Optimized handling of baking-plates and other accessories thanks to a suitable working height;

Limited space demand due to the missing front door;

Can fit in a narrow kitchen due to the missing front door;

The heat remains in the oven thanks to the closed oven chamber with bottom charging.

The swing-out supporting arrangement according to the invention enables appropriate kitchen equipment also in smaller housing units, such as students lodgings and apartment hotels.

Domestic ovens featuring the swing-out supporting arrangement according to the invention facilitates the work in the kitchen which is to a great advantage in connection with e.g. housing units for elder or disabled people.

Even if the description given above with reference to the drawings has been made in connection with an example wherein the swing-out supporting arrangement has been used in a preferred domestic oven charged through the bottom, the man skilled in the art will appreciate that the inventive principle can also be used in an oven mounted on a wall at a low level or standing on the floor where the oven ceiling forms the manauvring plane of the supporting arrangement.

In addition, the principle of invention is not restricted to domestic ovens but can be used also in kitchen equipment of another type, such as cabinets, freezers and fridges, dishwashing machines and the like.

What is claimed is:

1. An oven comprising:

a doorless front wall, opposing side walls, and opposing end walls, which cooperate together to at least partially define an oven chamber;

a swing-out supporting arrangement (7) for charging of goods into said oven chamber (1), said supporting arrangement comprising a linkage (9, 10) turnably journalled to at least one of the front wall, side walls, and end walls, inside of the oven chamber;

wherein the supporting arrangement comprises a first one of the end walls, said supporting arrangement being connected to the linkage so as to be movable between a first position inside the oven chamber, wherein said first one of the end walls closes said oven chamber, and a second swung-out position outside of the oven chamber (1), wherein said first one of the end walls is vertically spaced from said oven chamber, and at least partially disposed in front of the front wall (2).

2. The oven according to claim 1, further comprising:

a transmission element disposed at a first one of the side walls; and wherein the linkage (9,10) comprises a link arm pair journalled to the first one of the side walls (5) immediately adjacent to the fixed front wall (2) interconnecting said side walls, said link arm pair including a first link arm (9) having a first forward end (11) secured to a supporting shaft turnably journalled to the first one of the side walls at the immediate vicinity of the central portion of the first one of the side walls, the opposite end of the first link arm (9) being connected to the supporting arrangement, and a second link arm (10) of said link arm pair having one end secured to a turning shaft (14) of the transmission element (18-22), the opposite end of said second link arm (10) being turnably secured to the supporting arrangement.

3. The oven according to claim 2, wherein the transmission element (18-22) comprises an electric motor (18) rotatable between two end positions and having an output shaft (19) supporting a first eccentric (20) connected via a transmission arm (21) to a second eccentric (22) fixed to the turning shaft (14).

4. The oven according to claim 3, wherein the electric motor (18), the first and second eccentrics (20, 22) and the transmission arm (21) are contained in a control housing (23) separate from the closed chamber (1).

5. The oven according to claim 3, further comprising:

load balancing means (25, 26) connected to the transmission element (18-22) for helping balance the weight of the supporting arrangement.

6. The oven according to claim 5, wherein the load balancing means (25, 26) comprises a spring journalled on an outer end of an eccentric arm (25) connected to one of the supporting shaft (11) of the first link arm (9) and the control shaft (14) of the second link arm (10).

7. The oven according to claim 2, wherein the linkage further comprises a second link arm pair journalled to a second one of the side walls.

8. The oven according to claim 1, wherein the first one of the end walls is a bottom wall.

9. The oven according to claim 1, wherein the first one of the end walls is a top wall.

10. The oven according to claim 1, wherein the oven is adapted to be wall-mounted.

11. The oven according to claim 1, wherein the supporting arrangement is adapted to hold a baking plate.

* * * * *